United States Patent [19]

Davis

[11] 4,108,073

[45] Aug. 22, 1978

[54] ARMOR PIERCING PROJECTILE

[75] Inventor: Dale M. Davis, Freeport, Fla.

[73] Assignee: The United States of America as represented by the Secretary of the Air Force, Washington, D.C.

[21] Appl. No.: 553,854

[22] Filed: Feb. 27, 1975

[51] Int. Cl.[2] ..... F42B 13/04

[52] U.S. Cl. ..... 102/52; 102/92.3

[58] Field of Search ..... 102/52, 92.3, 92.4, 102/95

[56] References Cited

U.S. PATENT DOCUMENTS

| | | | |
|---|---|---|---|
| 2,849,591 | 8/1958 | Fullerton et al. | 102/105 |
| 2,983,224 | 5/1961 | Prosen et al. | 102/93 |
| 3,507,221 | 4/1970 | Grolly | 102/52 |
| 3,754,507 | 8/1973 | Dillinger et al. | 102/52 |

FOREIGN PATENT DOCUMENTS

| | | | |
|---|---|---|---|
| 638,756 | 6/1950 | United Kingdom | 102/92.3 |
| 887,124 | 1/1962 | United Kingdom | 102/52 |

*Primary Examiner*—Verlin R. Pendegrass
*Attorney, Agent, or Firm*—Joseph E. Rusz; Arsen Tashjian

[57] ABSTRACT

An armor piercing projectile configuration which provides strength, rigidity and mass properties sufficient to permit long thin armor piercing cores to be fired from guns in a stable and accurate manner. The core is supported at both ends in such a way that a monocoque skin or shell provides rigidity and the space between the core and the shell is filled with rigid material or structure so as to support the core throughout substantially all of its length. The shell is of relatively high density adding to the lateral/transverse moment of inertia ratio to provide gyroscopic stability for the long thin core.

2 Claims, 2 Drawing Figures

ARMOR PIERCING PROJECTILE

STATEMENT OF GOVERNMENT INTEREST

The invention described herein may be manufactured and used by or for the Government for governmental purposes without the payment of any royalty thereon.

BACKGROUND OF THE INVENTION

This invention relates to an armor piercing projectile and, more particularly, the invention is concerned with providing a relatively lightweight projectile wherein a drawn metal monocoque jacket provides rigid support for a long thin penetrator core by means of a low density filler which is disposed between the core and the jacket thereby effectively concentrating the plurality of the mass in the long thin high density armor piercing core.

Heretofore, projectile designs contained a hardened steel penetrator that was the full diameter of projectile and shorter than the projectile length to reduce weight so that the initial launch velocity would be high, thus obtaining maximum initial penetrator energy. However, because of the large diameter of the projectile penetrator, a large amount of armor would have to be displaced to allow penetration. Therefore, the armor absorbs a large amount of the penetrating energy of the projectile so that a thinner armor prevents passage of the projectile. Also, by making the armor of greater hardness, the larger diameter steel projectiles would be shattered on impact thereby reducing projectile penetration.

It would be most desirable to provide an armor piercing projectile which includes a long, thin core so that only a small amount of armor would be displaced and less energy would be required to penetrate thicker armor. However, a thin core normally requires a massive structural support making the overall weight of the projectile very heavy. If the support is not sufficiently rigid, flexure and bending of the penetrator will result in poor launch, flight and impact conditions. Thus it can be seen that the support means for the thin penetrator should provide good rigidity while at the same time providing centering support with only minimal addition to the overall weight of the projectile.

SUMMARY OF THE INVENTION

The present invention provides an armor piercing projectile which permits a long thin core penetrator to be fired from a gun in a stable and accurate manner. The necessary strength rigidity and mass properties are provided by supporting the core within a monocoque skin or shell at both ends and filling the space between the core and the shell with rigid material or structure thereby supporting the core throughout all or most of its length. The shell is of relatively high density and adds to the lateral/transverse moment of inertia ratio providing gyroscopic stability for the long thin core.

Accordingly, it is an object of the invention to provide an armor piercing projectile wherein a long thin penetrator is rigidly supported within a drawn metal monocoque jacket or shell.

Another object of the invention is to provide an armor piercing projectile wherein a low density filler material is positioned between the shell and the long thin penetrator thereby providing centering support for the penetrator while keeping the overall projectile weight low.

Still another object of the invention is to provide an armor piercing projectile wherein a long thin core is supported and centered at each end and throughout its length by the jacket or structure transmitting loads to the jacket.

A further object of the invention is to provide a lightweight armor piercing projectile wherein the plurality of mass is concentrated in a long thin high density armor piercing core penetrator.

A still further object of the invention is to provide an armor piercing projectile which is fabricated of readily available materials and capable of being mass produced in large quantities by well known forming and machining operations.

These and other objects, features and advantages will become more apparent after considering the description that follows taken in conjunction with the attached drawings and appended claims.

DESCRIPTION OF A PREFERRED EMBODIMENT

Figure 1:
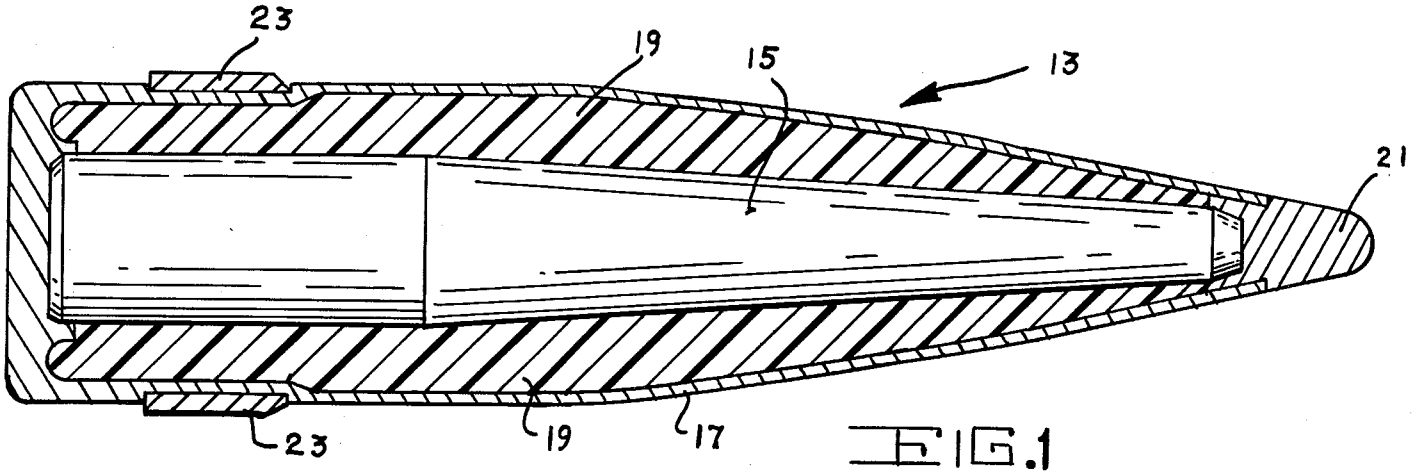
FIG. 1 is a view in cross section of one embodiment of the armor piercing projectile according to the invention showing the integral base plate and jacket with a separate nosepiece.

Referring now to the drawings, the armor piercing projectile is illustrated as a 30mm projectile in size and shape but is not limited to this specific caliber. In the embodiment of FIG. 1, the total projectile 13 is composed of five parts. A penetrator or core 15 generally made of any superior armor piercing material such as hard steel, alloy steel, tungsten carbide, tungsten alloy or uranium or its alloys, is relatively long and thin in configuration as compared to most previous designs. There is shown a typical configuration devised to give superior penetration against specific targets of concern and, although not specifically required, in order to realize the full benefit of the invention, the core 15 should be sufficiently long and thin as to be gyroscopically unstable in itself; in which case the construction will add stability to make it useful.

A jacket 17 is constructed of a rigid, high strength, relatively dense material such as steel. The jacket 17 serves to impart rigidity to the entire projectile 13 by preventing or reducing plastic and elastic deformation of the core 15 caused by stresses imparted to the projectile 13 during its acceleration down the gun bore. A further purpose of the jacket 17 is to increase the ratio of axial to transverse mass moments of inertia so as to provide gyroscopic stability to the assembly. Also, the jacket 17 provides a relatively hard surface to bear on the gun bore during projectile travel down the tube in order to minimize in-bore yaw and serves to hold the components together and distribute the setback forces during acceleration down the gun tube.

A filler 19 is disposed in the area between the core 15 and the jacket 17 and, preferably, is fabricated of a plastic material such as nylon, glass filled nylon or other suitable plastic. Also, within the meaning of the invention, the filler 19 could be metallic honeycomb or other lightweight metallic structure. The purpose of the filler 19 is to support the core 15 along its length and to distribute stresses between the core 15 and the jacket 17 so as to preclude buckling or bending induced by the accelerations imparted during passage down the tube.

A nosepiece 21 is positioned at the forwardmost portion of the projectile 13 and serves to center the front of the penetrator 15 in the projectile 13 and transfer forces, which tend to bend the core 13, to the jacket 17. The nosepiece 21 may be made of aluminum or, alternatively, it could be of steel, fiberglass or other strong, rigid engineering material. The last of the elements of the embodiment of FIG. 1 is a rotating band 23 which is positioned around the outer surface of the jacket 17 near the rearward end of the projectile 13. The rotating band 23 serves to impart rotation to the projectile 13 as it passes through the gun bore and seals the bore in a manner well known. Plastic, gilding metal, sintered iron as well as other well known rotating band material can be used to fabricate the band 23.

Figure 2:
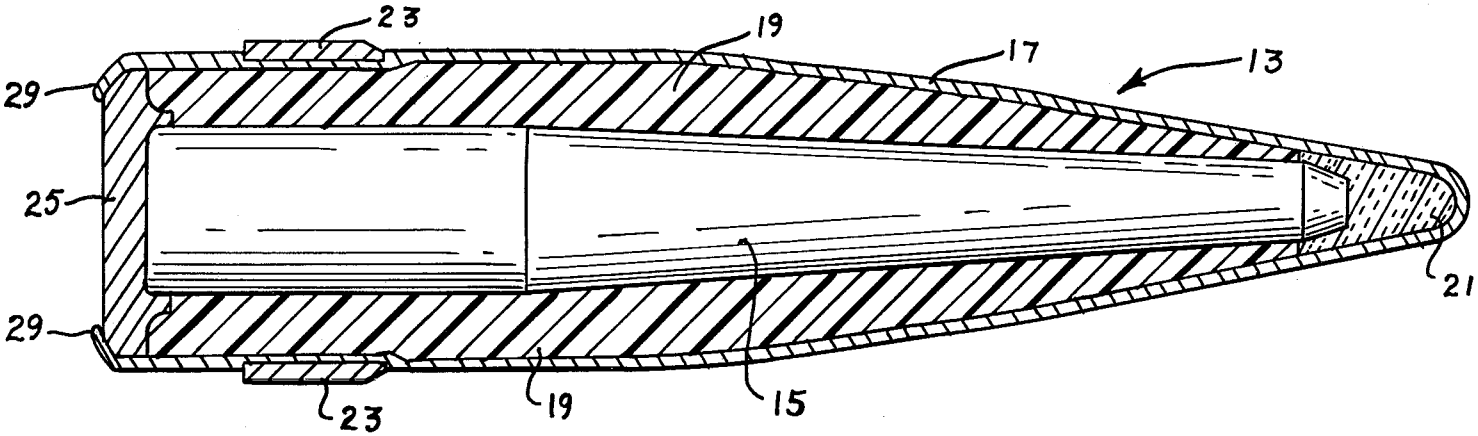
FIG. 2 is a view in cross section of another embodiment of the armor piercing projectile according to the invention showing a jacket with an enclosed front end with a separate noseplug and base plate.

In the embodiment of the invention shown in FIG. 2, like reference numerals are used to identify elements comparable to those shown in FIG. 1. It can be seen that the second embodiment is similar in most respects to the first, differing therefrom in the fact that a separate base plate 25 is attached at the rearwardmost portion of the projectile 13. A sealant 27 may be applied to seal the rearward end of the projectile 13 and prevent gases from reaching the interior of the projectile 13. The base plate 25 serves to help distribute the setback forces during acceleration down the gun bore. Also, it should be noted that a noseplug 21 is enclosed by the jacket 17 in this second embodiment.

METHOD OF MANUFACTURE

One means of fabrication, although not exclusive, will be described below with reference to both embodiments. The core 15 can be manufactured by machining, heat treating and grinding or other well known method of forming armor piercing cores. The filler 19 if made of plastic should preferably be formed by injection molding although it may be machined on a lathe or automatic screw machine. The nosepiece 21 if aluminum should be fabricated by cold forming or by automatic screw machine or, alternatively, if fiberglass, it should be injection molded or machined. The rotating band 23 may be fabricated and attached by any of several well known means of attaching rotating bands to projectile bodies such as injection molding a plastic band over a bonding agent.

A preferred means of fabricating the jacket 17 and assembling the projectile 13 in the first embodiment as depicted in FIG. 1 would consist of fabricating the jacket 17 by a blank cup and draw operation in a manner identical to that used in the fabrication of cartridge cases except that the jacket 17 is left cyclindrical and not necked down. The core 15 and filler 19 are then inserted and pressed firmly into their recesses in the base of the jacket 17. A necking die (not shown) is then forced down over the front of the jacket 17 reducing the front diameter to slightly larger than the nosepiece 21 and forcing the major portion of the jacket 17 into intimate contact with the filler 19. The jacket 17 should then be trimmed to the required length, the nosepiece 21 inserted, and a finish die forced over the assembly to finish forming the projectile 13 to the desired shape. The rotating band seat should now be machined and the rotating band 23 installed as above described.

In the second embodiment as depicted in FIG. 2 the jacket 17 and base plate 25 are not integral as in the first embodiment. In this second embodiment the jacket 17 is formed by blank cup and draw operations in a manner identical to that used in the fabrication of rifle caliber bullet jackets. The aft portion is left sufficiently oversize to permit the insertion of the filler 19 from the rear. After the jacket 17 is formed, the noseplug 21, filler 19, and core 15 are inserted. The entire assembly is then forced into a drawing die (not shown) to reduce the jacket 17 diameter to the desired dimension and capture the filler 19. With the assembly sitting in a form fitting die, the base plate 25 is pressed and firmly held in position while the jacket 17 is rolled or swaged over the base plate 25. The base plate 25 should be of steel, aluminum or other high strength structural material and preferably should be manufactured by automatic screw machine, lathe or cold forming. The rotating band should now be machined and the band 23 installed as described above.

In a high efficiency munition according to the invention, there is produced a projectile having ballistic properties which are especially suitable for high speed automatic weapons. In comparision with a bullet of the same caliber in which the core bears directly against the inner surface of the jacket, the hereinbefore described projectile has a smaller diameter core of heavier material. This novel arrangement has the unusual advantage of producing superior ballistic properties, especially increased depth of penetration, while maintaining the same overall weight and other ballistic conditions.

Although the invention has been described in the foregoing specification in terms of preferred embodiments thereof, it should be understood that some variations and modifications can be made in the construction details and relative size and shape of the elements without departing from the true spirit and scope of the appended claims.

Having thus described my invention, what I claim and desire to secure by Letters Patent of the United States is:

1. An armor piercing projectile suitable for firing through a rifled gun bore, said projectile comprising, a long thin penetrator core element having a tapered forward portion, a monocoque jacket substantially surrounding said core and in spaced relation thereto, a rigid inert filler material disposed between said core and said jacket for supporting said core throughout substantially all of its length, and centering means including a separate nosepiece insertable into the open forward end of said jacket and engaging the forwardmost portion of said core for holding said core in the central area of said projectile, the rearwardmost portion of said core engaging the base portion of said jacket thereby providing the required strength, rigidity and mass properties to said projectile during acceleration through the gun bore while at the same time providing for superior penetration against specific targets.

2. An armor piercing projectile suitable for firing through a rifled gun bore, said projectile comprising, a long thin penetrator core element having a tapered forward portion, a monocoque jacket substantially surrounding said core and in spaced relation thereto, a rigid inert filler material disposed between said core and said jacket for supporting said core throughout substantially all of its length, and centering means including a noseplug positioned within the forwardmost portion of said jacket for engagement with the forward end of said core for holding said core in the central area of said projectile, and a base plate insertable into the open rearward end of said jacket for engaging the rearward end of said core and said filler material thereby providing the required strength, rigidity and mass properties to said projectile during acceleration through the gun bore while at the same time providing for superior penetration against specific targets.

* * * * *